US010874173B2

(12) United States Patent
Wright

(10) Patent No.: US 10,874,173 B2
(45) Date of Patent: Dec. 29, 2020

(54) ADJUSTABLE ANTI-SLIPPAGE SHOE SLING

(71) Applicant: Tina Richardson Wright, Myrtle Beach, SC (US)

(72) Inventor: Tina Richardson Wright, Myrtle Beach, SC (US)

( * ) Notice: Subject to any disclaimer, the term of this patent is extended or adjusted under 35 U.S.C. 154(b) by 0 days.

(21) Appl. No.: 16/125,487

(22) Filed: Sep. 7, 2018

(65) Prior Publication Data

US 2019/0075890 A1 Mar. 14, 2019

Related U.S. Application Data

(60) Provisional application No. 62/557,583, filed on Sep. 12, 2017.

(51) Int. Cl.
*A43B 23/28* (2006.01)
*A43C 11/14* (2006.01)

(52) U.S. Cl.
CPC ..... *A43B 23/28* (2013.01); *A43C 11/14* (2013.01)

(58) Field of Classification Search
CPC ..... A43B 23/28; A43B 7/1495; A43B 3/18; A43B 5/0439; A43B 5/0443; A43C 11/14
USPC ... 36/7.6, 7.7, 11.5, 50.1, 58.5, 58.6, 88, 89, 36/92, 102, 105, 112, 118.1, 118.2, 118.9, 36/125, 136, 169, 170
See application file for complete search history.

(56) References Cited

U.S. PATENT DOCUMENTS 136,649 A * 3/1873 Goldthwait ..... A43B 23/28 36/58.5
439,909 A * 11/1890 Teggart ..... A43B 23/28 36/58.5
1,202,451 A * 10/1916 Stern ..... A43C 15/06 36/7.6
1,572,213 A * 2/1926 Lucas ..... A43B 3/0052 36/170
1,845,031 A * 2/1932 Gilbert ..... A43B 7/00 36/140
2,216,947 A * 10/1940 Jones ..... A43C 15/02 36/7.7
2,932,096 A * 4/1960 Tavormina ..... A43C 15/063 36/7.7
2,936,533 A * 5/1960 Paynor ..... A43B 3/126 36/105
2,969,600 A * 1/1961 Meltzer ..... A43B 23/28 36/58.5
2,976,623 A * 3/1961 Gallaway ..... A43B 3/122 36/11.5
3,214,850 A * 11/1965 McNair ..... A43C 15/06 36/62

(Continued)

FOREIGN PATENT DOCUMENTS

DE 448175 C * 8/1927 ..... A43B 3/18

*Primary Examiner* — Sharon M Prange
*Assistant Examiner* — Grace Huang

(57) ABSTRACT

One example embodiment in this disclosure provides an apparatus including a retainer, anchored at a heel position within a shoe. The apparatus also includes a heel strap having a first and second end and a mid-section, wherein the first and second end of the heel strap is anchored on a sole of a shoe, and wherein the mid-section of the heel strap is attached to the retainer. The apparatus also includes an adjuster associated with the heel strap configured to adjust length of the heel strap.

18 Claims, 11 Drawing Sheets

(56) References Cited

U.S. PATENT DOCUMENTS 3,867,771 A * 2/1975 Levine ..... A43B 3/00 36/11.5
4,005,533 A * 2/1977 Anderson ..... A43C 15/065 36/62
4,200,997 A * 5/1980 Scheinhaus ..... A43B 3/126 36/11.5
4,454,662 A * 6/1984 Stubblefield ..... A43B 5/00 36/102
4,869,000 A * 9/1989 York, Jr. ..... A43B 3/122 36/11.5
4,920,664 A * 5/1990 McGregor ..... A43B 3/126 36/11.5
5,894,684 A * 4/1999 Sand ..... A43B 7/20 36/115
6,237,250 B1 * 5/2001 Aguerre ..... A43B 3/122 36/11.5
6,516,538 B2 * 2/2003 Kraft ..... A43B 3/126 36/101
6,923,697 B1 * 8/2005 Wagner ..... A63B 31/11 36/58.6
7,398,607 B1 * 7/2008 Garcia ..... A43B 1/0072 36/101
7,439,837 B2 * 10/2008 McDonald ..... A43B 3/126 36/11.5
7,819,721 B1 * 10/2010 Messier ..... A43B 1/0054 450/86
9,456,653 B2 * 10/2016 Ueda ..... A43B 7/1495
10,405,600 B2 * 9/2019 Ferguson ..... A43B 23/24
2008/0000104 A1 * 1/2008 Rastegar ..... A43C 15/16 36/62
2008/0040889 A1 * 2/2008 Edwards ..... A43B 3/163 16/42 R
2008/0040947 A1 * 2/2008 Burgess ..... A43B 5/0419 36/7.6
2008/0301860 A1 * 12/2008 Iqbal ..... A41D 13/0562 2/455
2010/0018082 A1 * 1/2010 Stokes ..... A43B 7/16 36/36 R
2012/0042545 A1 * 2/2012 Dickerson ..... A43B 3/20 36/136
2012/0137540 A1 * 6/2012 Vattes ..... A43B 7/142 36/11.5
2013/0199055 A1 * 8/2013 Shahane ..... A43B 13/38 36/43
2014/0068972 A1 * 3/2014 Barrow ..... A43B 3/16 36/105
2014/0305002 A1 * 10/2014 Murietta ..... A43B 1/0027 36/11.5

* cited by examiner

ADJUSTABLE ANTI-SLIPPAGE SHOE SLING

CROSS-REFERENCE TO RELATED APPLICATION AND CLAIM OF PRIORITY

This application claims priority under 35 U.S.C. § 119(e) to U.S. Provisional Patent Application No. 62/557,583 filed on Sep. 12, 2017. The above-identified provisional patent application is hereby incorporated by reference in its entirety.

TECHNICAL FIELD

This disclosure is generally directed to footwear and more particularly to a shoe sling configured to improve comfort and fit of a shoe.

BACKGROUND

Shoe inserts increase comfort of the wearer. For example, shoe inserts can provide an improved fit, increased comfort, additional cushion, reduced smell, increased athletic performance, relief from foot/joint pain, and the like. Additionally, shoe inserts can include medical orthotics and be provided by a medical provider such as a physician.

Often, conventional footwear can be uncomfortable and painful to walk in, especially if the footwear is not an ideal fit. Further, even if a shoe is an ideal fit, throughout the course of a typical day the size of one's foot can change, which can cause the footwear to become uncomfortable and even painful. For example, the size of one's foot can change due to swelling. Swelling of one's feet is common the longer one remains standing throughout a typical day. Additionally, blisters and other types of skin irritants are often caused when one's foot continually rubs along the inside of a shoe. Such rubbing can be caused by an improper fit, the presence of moisture in the shoe, the change in the shape of one's foot due to swelling, etc.

SUMMARY

This disclosure provides an adjustable anti-slippage shoe sling.

In one embodiment an apparatus is provided. The apparatus includes a retainer, anchored at a heel position within a shoe; a heel strap having a first and second end and a mid-section, wherein the first and second end of the heel strap is anchored on an insole of a shoe, and wherein the mid-section of the heel strap is attached to the retainer; and an adjuster associated with the heel strap configured to adjust length of the heel strap.

In one embodiment a shoe is provided. The shoe includes a retainer, anchored at a heel position within the shoe; a heel strap having a first and second end and a mid-section, wherein the first and second end of the heel strap is anchored on an insole of a shoe, and wherein the mid-section of the heel strap is attached to the retainer; and an adjuster associated with the heel strap configured to adjust length of the heel strap.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The term "shoe" in is not intended to be limiting in any fashion, but may be applied to any form of footwear that additional feature may be add too. The figures of this disclosure depict shoes with both high heeled and no heel ("flats") designs in order to illustrate that various features of this disclosure are applicable to shoes of any style and for any gender. The figures and associated description below are not intended to limit use of various features of the present disclosure.

The term "walking" is used for convenience, and includes running, jogging, or other types of pedal movement.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of the present disclosure and its advantages, reference is now made to the following description, taken in conjunction with the accompanying drawings, in which like reference numerals represent like parts.

DETAILED DESCRIPTION

Figure 1:
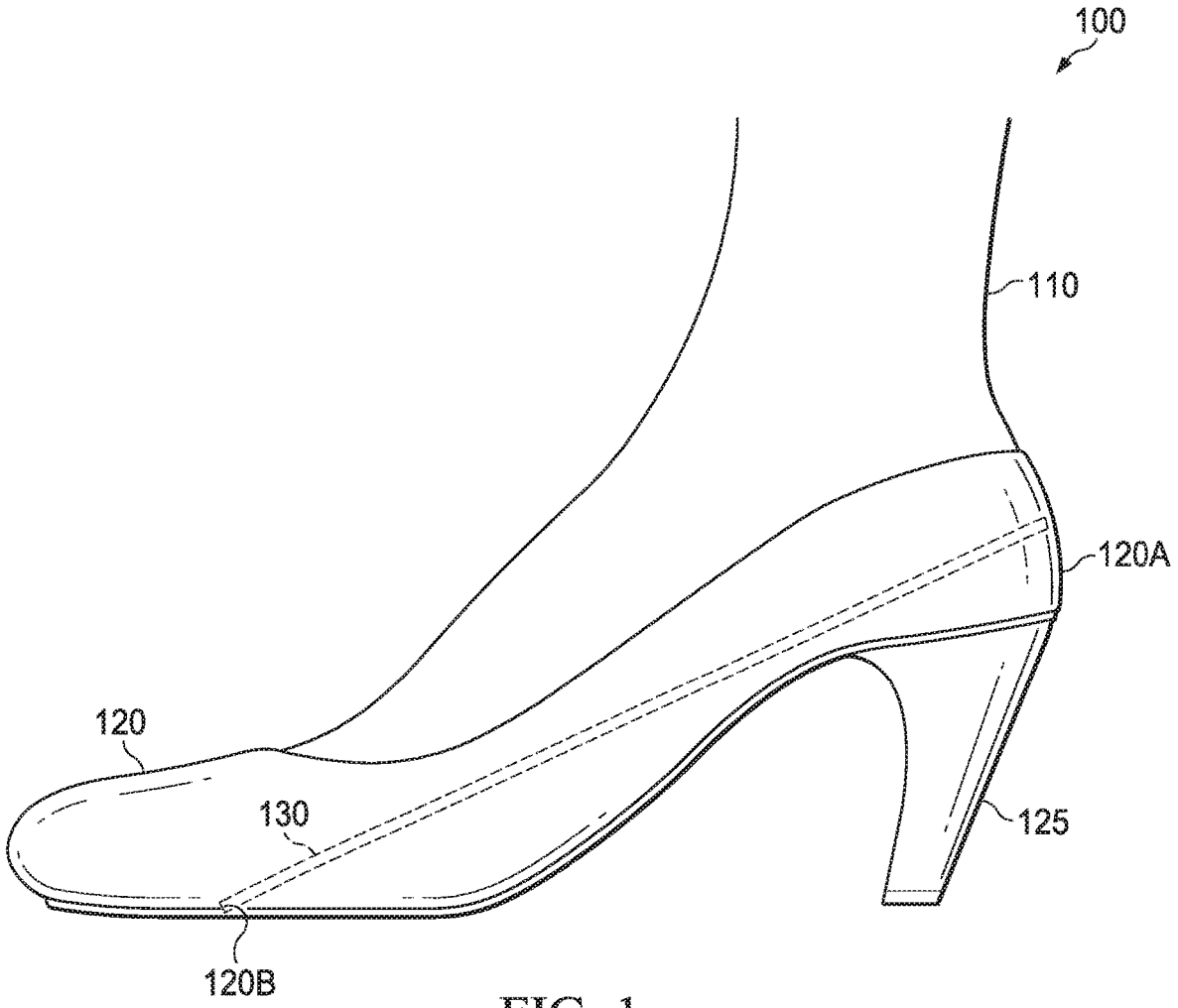
FIG. 1 illustrates a side elevation of a shoe worn by a user with a shoe sling located within the shoe, according to an embodiment of this disclosure.

FIGS. 1 through 6B, discussed below, and the various embodiments used to describe the principles of the present disclosure in this patent document are by way of illustration only and should not be construed in any way to limit the scope of the disclosure. Those skilled in the art will understand that the principles of this disclosure may be implemented in any suitably arranged device or system.

Normal walking patterns involve three parts. First, the 'heel strike' occurs when the heel comes in contact with the ground. Next the 'roll' is when the foot rolls from the heel through the ball of the foot. The 'toe-off' involves the lifting of the ball of the foot from the ground. The process repeats with respect to each foot for each step. Embodiments of the present disclosure describe a foot enclosed by a shoe during the typical three part process of walking. If the shoe continually rubs one or more portions of the foot, the rubbing may cause skin irritation. The skin irritation creates significant pain for to the wearer during each sequential step. Common places of irritation are along the heel, the ball of the foot, and the side of the foot.

Embodiments of the present disclosure recognize that often shoes may lead to skin irritation, blisters, and injuries of the foot, if the shoe is not in ideal fit. For example, new shoes are often stiff and can cause rubbing leading to potential injuries. In another example, shoes can be designed for style and appearance over comfort, and as a result, the shoe can rub and slip which can create skin irritation or cause other types of injuries to the wearer of the shoe.

Embodiments of the present disclosure further recognize and take into consideration that shoes that are not an ideal fit that can lead to injuries. For example, an injury can be caused from repetitive rubbing of two surfaces, such as a foot of a user that rubs along an inner surface of a shoe, Such rubbing can cause the skin to become irritated, or can cause the user to slip and fall which can cause significant damage to both the user and sounding objects.

Therefore, embodiments of the present disclosure provide a shoe sling that is affixed to the inside of a shoe. The sling dynamically adjusts the fit of the shoe by providing tension along the foot to maintain proper placement of a foot within a shoe. The shoe sling also limits the rubbing between the foot and the shoe, as the foot is protected and confined by the sling. In certain embodiments, the sling maintains a continual grip around the heel and the sides of the foot in order to eliminate rubbing and slipping of the foot along the inside of the shoe. The shoe sling forms around the foot of a wearer and secures the foot inside the shoe to improve the fit of the shoe and prevent excessive rubbing of a foot against the inside of a shoe.

Embodiments of the present disclosure provide a shoe sling that can be manufactured inside of a shoe. A shoe sling that is manufactured inside a shoe is part of the shoe. In certain embodiments, the shoe sling can be added after the manufacturing of the shoe by an end user or wearer of the shoe, or another person such as a shoe repair person, a shoe sales representative, and the like. In certain embodiments, the shoe sling is adjustable to maintain a secure fit around the foot of a wearer.

The shoe sling is affixed at the portion of the shoe that wraps around the heel of the wearer. The shoe sling is also affixed in proximity to the toe box of the shoe near the location where the ball of the foot rests. Since the shoe sling is affixed to multiple parts of a shoe, the shoe sling can wrap around the foot of the wearer, such as from the heel of the user, along the sides of the foot, and towards the ball of the foot.

FIG. 1 illustrates a side elevation of a shoe worn by a user with a shoe sling, according to an embodiment of this disclosure. The embodiment of FIG. 1 is for illustration only. Other embodiments can be used without departing from the scope of the present disclosure.

In particular, FIG. 1 illustrates environment 100, depicting a side elevation of a shoe 120 worn by a user 110 with a heel strap member 130. It is noted that the shoe 120 and heel strap member 130 may come in a wide variety of configurations, and FIG. 1 does not limit the scope of this disclosure to any implementation of the heel strap member 130.

As depicted, shoe 120 is a high-heeled shoe as indicated by heel 125. In certain embodiments, the shoe 120 is any type of shoe that includes a heel portion of any size, including by not limited to boots, flats, sneakers, athletic shoes, mid heel shoes, wedge shoes, etc.

In certain embodiments, the heel strap member 130 resembles a sling as it wraps around the heel of the user 110. The heel strap member 130 is located inside shoe 120 and depicted by dashed lines. The heel strap member 130 can be affixed to the inside of the shoe at approximately location 120A and location 120B and wraps around the outside of a wears foot when the foot is inside of the shoe 120. The heel strap member 130 attaches at the heel of the shoe of the user at location 120A and is anchored at or near the ball of user's 110 foot at location 120B on both the lateral and medial sides of the foot. Details regarding the attachment of the heel strap member 130 at location 120A are discussed in greater detail below with respect to FIGS. 3A, 3B, 5A, 5B, and 5C. Location 120B approximates the ball of user's 110 foot. In certain embodiments, the heel strap member 130 is attached to the right side and the left side of the user's 110 foot at location 120B. Alternatively, the heel strap member 130 is formed as a loop and attached at a single location at or near location 120B.

The heel strap member 130 wraps around the foot of the user, from the heel of the foot to the ball of the foot to reduce and/or eliminate rubbing of the foot against the shoe 120. The heel strap member 130 allows the user's 110 foot to be in continual contact with the heel strap member 130 in lieu of the shoe 120 while maintaining a secure and comfortable fit. The heel strap member 130 slips around the heel of one's foot within the shoe 120 and applies tension to retain the foot in a forward position. By applying tension to the foot, the heel strap member 130 protects the heel of the foot from rubbing along the heel compartment of the shoe 120 near location 120A. Similarly, by wrapping around the heel of a user, the heel strap member 130 places a barrier around heel to protect the heel of the user 110 from any rubbing from the heel compartment of the shoe 120.

The use of the heel strap member 130 is not dependent on any specifically designed shoe. In certain embodiments, of the present disclosure, the heel strap member 130 and its associated components can be added to the shoe 120 by user 110. For example, the heel strap member 130 is affixed via an adhesive member (not depicted) at locations 120A and 120B. In another example, the heel strap member 130 is affixed via a hook member (not depicted) at locations 120A and 120B. In another example, the heel strap member 130 is directly stitched into shoe 120, at locations 120A and 120B. The heel strap member 130 can be affixed at locations 120A and 120B, via any combination described or known in the art including both mechanical and chemical methods to affix two objects together.

The heel strap member 130 is configured to slip over user's 110 heel at or near the location 120A of the shoe 120. The heel strap member 130 is secured to the foot of the user 110 and prevents the user's 110 foot from being displaced within the shoe 120, by (i) affixing the heel strap member 130 to the shoe 120 at location 120A, and (ii) placing the heel strap member 130 around the user's 110 heel.

Figure 2A:
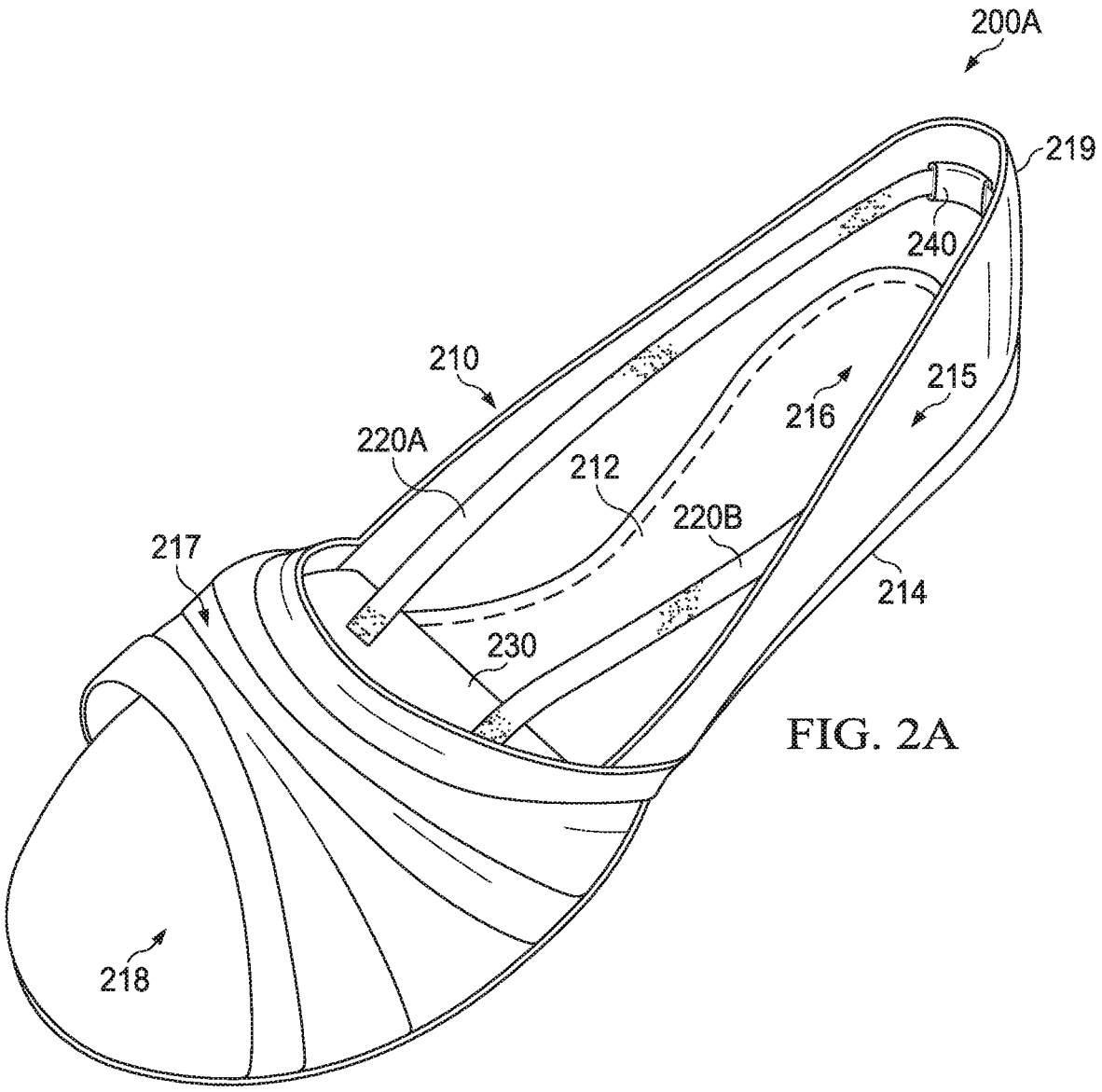
FIG. 2A illustrates a side perspective view of a shoe with a shoe sling, according to an embodiment of this disclosure.
Figure 2B:
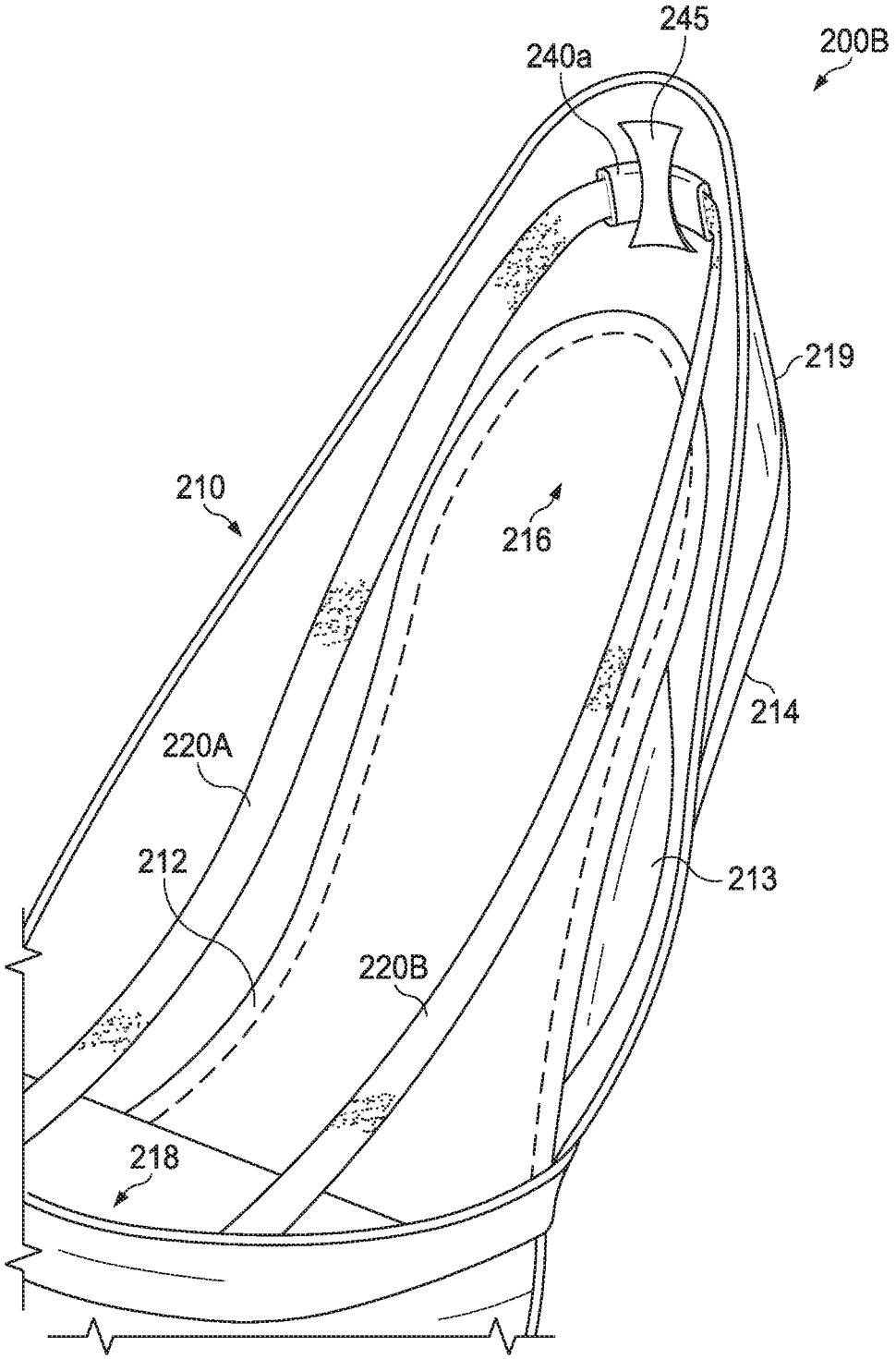
FIG. 2B illustrates a top perspective view of a shoe with a shoe sling, according to an embodiment of this disclosure.

FIG. 2A illustrates a side perspective view of a shoe with a shoe sling, according to an embodiment of this disclosure. In particular, FIG. 2A illustrates environment 200A, depicting a side perspective view of a shoe with a shoe sling. FIG. 2B illustrates a top perspective view of a shoe with a shoe sling, according to an embodiment of this disclosure. In particular, FIG. 2B illustrates environment 200B, depicting a top perspective view of a shoe with a shoe sling. The various elements FIG. 2A are similarly to those of FIG. 2B. The embodiments of environment 200A of FIG. 2A and environment 200B of FIG. 2B are for illustration only. Other embodiments can be used without departing from the scope of the present disclosure.

Shoe 210 includes an insole 212, an outsole 214, a quarter (i.e., side portion) 215, a heel seat 216, a top portion 217, a toe region 218, and a heel quarter 219. The insole 212 is a layer of material that is inside the shoe 210 and in contact with the bottom of the foot of the wearer. The outsole 214 is the exposed part of the shoe 210 that is contact with the ground. The quarter 215 is the rear and sides of the upper portion of a shoe that surrounds the foot. That is, the quarter 215 is the external surface of the shoe that is exposed to the environment and the internal surface that forms around the foot of the user. The heel seat 216 is generally where the heel of the wearer sits in the shoe 210. The top portion 217 covers a portion of the arch of the foot of the wearer and can extend to fully cover the toes of the wearer. In certain embodiments, the top portion 217 can extend from the toe region 218 to an opening that allows the foot of a user to be inserted. The toe region 218, commonly known as the toe cap in closed-toed shoes, is the inside of the shoe 210 that is in contact with the toes of the wearer. The heel quarter 219 illustrates the rear of the shoe 210 that surrounds the heel of the wearer. FIG. 2B also illustrates an arch support 213. The arch support 213 supports the arch of the foot of a wearer of the shoe 210.

When a foot is placed within the shoe 210, the foot rests on the insole 212. Additionally, when a foot is placed within the shoe 210, the heel of the foot rests on the heel seat 216 and the toes of the foot rest within the toe region 218. Further, when a foot is placed within the shoe 210, the heel of the foot is positioned along the heel quarter 219 and the top of the foot is held in place by the top portion 217, while the side of the foot held in place by side portion of the quarter 215.

Shoe 210 illustrates the heel strap members 220A and 220B (collectively referred to as "sling 220"), attached to the shoe 210 at the anchor 230 and at the retaining loop 240. The heel strap members 220A and 220B are similar to the heel strap member 130 of FIG. 1.

Figure 3A:
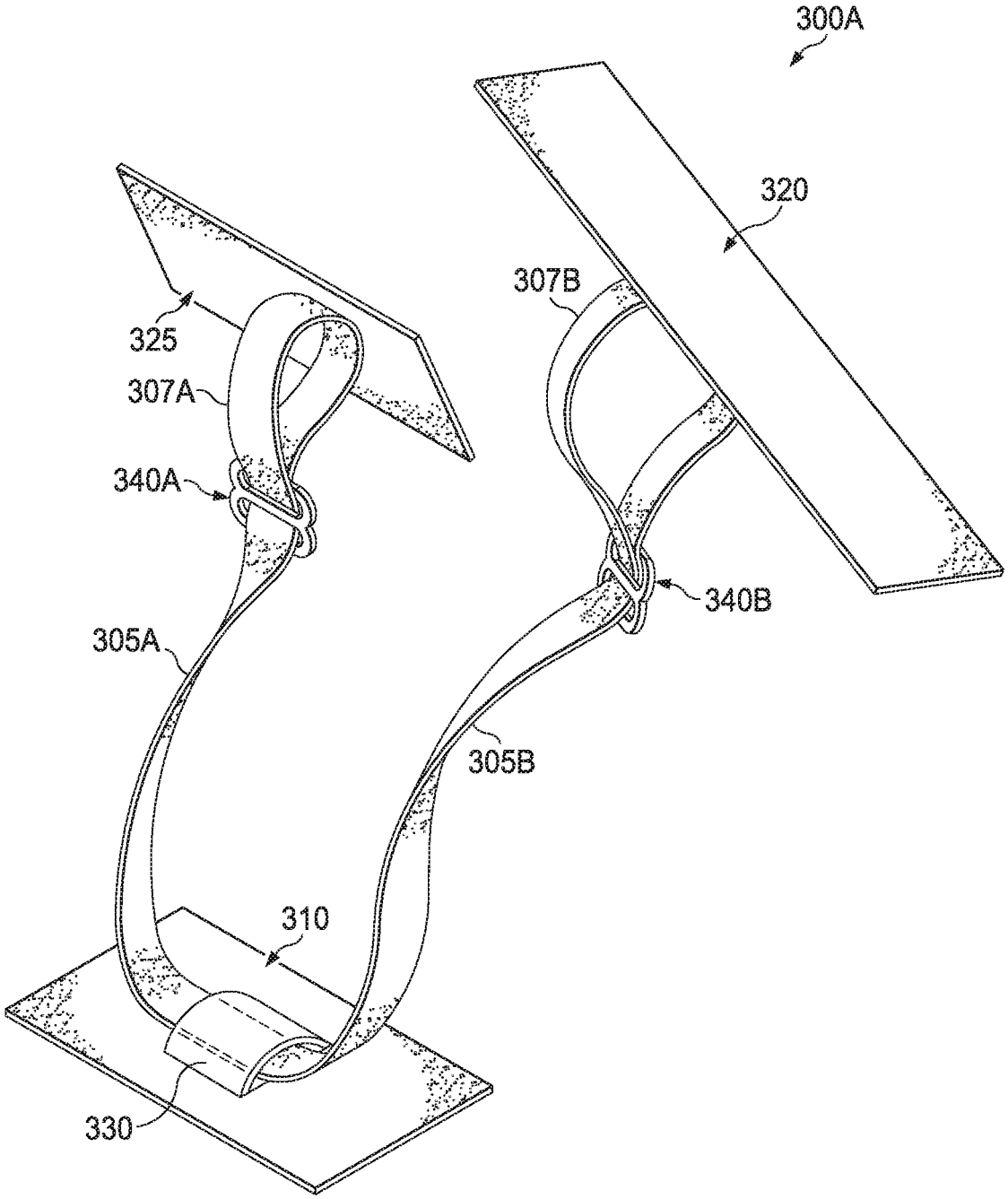
FIGS. 3A and 3B illustrates a shoe sling, according to an embodiment of this disclosure.
Figure 3B:
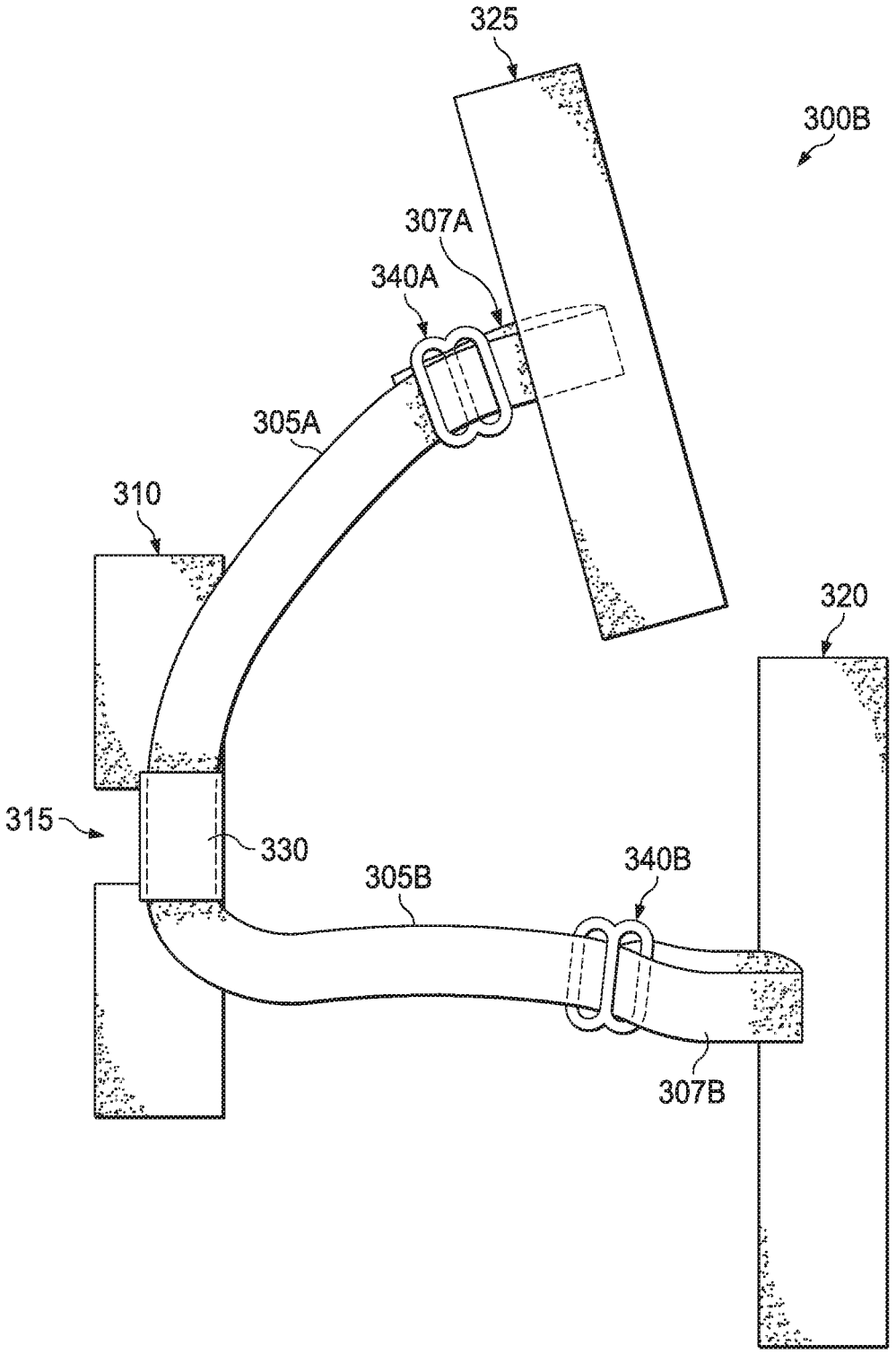

In certain embodiments, the sling 220 may be a continuous element that is affixed by the retaining loop 240. The sling 220 is also affixed at the anchor 230. In certain embodiments, the anchor 230 is a single component to which the heel strap members 220A and 220B both are both affixed. For instance, the heel strap member 220A is affixed on the right side of the shoe 210 at the anchor 230 and the heel strap member 220B is affixed to the left side of the shoe 210 at the anchor 230. In certain embodiments, the anchor 230 is two separate components (such as illustrated in FIGS. 3A, 3B, and 5B). For example, the heel strap member 220A is affixed to one anchor and the heel strap member 220B is affixed to the other anchor.

The sling 220 can be affixed by the retaining loop 240. The retaining loop 240 may be a flexible tube, such as a cylindrical shape, that allows the sling 220 to freely move through the retaining loop 240. For example, the sling 220 may pass through and move freely within the retaining loop 240. Alternatively, the sling 220 may be fastened to the retaining loop 240, such that the sling 220 is fixed and prevented to move within the retaining loop 240.

The sling 220 is dimensioned and sized to fit around the heel of a wearer or user's foot while inside the shoe 210. The thickness of the sling and the length of the sling are sized to fit comfortably around the foot of the user while the foot is inside of a shoe. The thickness or width of the sling 220 can altered depending on the type of shoe. The heel strap member 220A and 220B is constructed of any flexible or resilient material or fabric material. Materials may include leather, rubber, nylon, silicone, polyester, cotton, silk, spandex (i.e., Lycra™), synthetic, and the like. Materials can also include various types of plastics such as vinyl, polyethylene, polyurethane, among others.

The heel strap member 220A and 220B may be any color. For example, the heel strap can be white, nude, black, red, orange, yellow green, blue, violet, a color that matches the color of shoe 210, or any combination thereof. The heel strap member 220A and 220B can also be transparent, opaque, semi opaque, or a combination thereof.

The retaining loop 240 of FIG. 2A is similar to the retaining loop 240A and the retaining anchor 245 (collectively referred to as the 'retainer assembly') of FIG. 2B. In certain embodiments, the sling 220 is able to freely pass through the retaining loop 240A. For example, the retaining loop 240A is a loop of a cylindrical shape, with a hollow center. The sling 220 is positioned within the hollow portion of the retaining loop 240A, such that the sling 220 can freely move to extend the heel strap members 220A while shortening the heel strap members 220B, or conversely, contract the heel strap members 220A while extending the heel strap members 220B. In certain embodiments, the sling 220 is affixed within the retaining loop 240A and is unable to move within the retaining loop 240A. The retaining anchor 245 anchors the retaining loop 240A to the inside of shoe 210 at the heel quarter 219. Retaining anchor 245 may allow the retaining loop 240A to stretch and provide a slack to the sling 220. For example, when the shoe 210 is worn by a user, the user's heel may be secured against the retaining anchor 245 and not the heel of the shoe. By securing the user's heel to the retaining anchor 245 instead of the shoe 210, the retaining anchor 245 will not slide/rub on user's heel as the user walks. For example, as the user walks the retaining anchor 245 will fit snugly against the heel of the foot of the user and prohibit or reduce rubbing of the foot against the inside of the shoe at or near the heel quarter 219. Since the sling is also affixed at the anchor 230, the sling can hold the foot of the user away from the back of the foot and still provide the necessary support, without affecting how the shoe grips the foot of the user or the gait of the user. That is, the retainer assembly creates a gap between the user's heel and the shoe 210. In certain embodiments, the retaining anchor 245 is affixed around the outer circumference of the retaining loop 240A. In certain embodiments, the retaining anchor 245 and the retaining loop 240A are a single element and are affixed to the heel quarter 219 of the shoe 210.

FIGS. 3A and 3B illustrate a schematic view of a shoe sling, according to an embodiment of this disclosure. FIG. 3A depicts environment 300A. FIG. 3B depicts environment 300B. The embodiments of the environments 300A and 300B of FIGS. 3A and 3B are for illustration only. Other embodiments can be used without departing from the scope of the present disclosure. For example, the heel strap members 305A and 305B (collectively referred to sling 305) may come in a wide variety of configurations, and FIGS. 3A and 3B do not limit the scope of this disclosure to any implementation of the sling 305. Various elements between FIGS. 3A and 3B are similar.

The sling 305 is similar to the heel strap member 130 of FIG. 1, the heel strap members 220A and 220B of FIGS. 2A and 2B. The retaining loop 330 is similar to the retaining loop 240 of FIG. 2A, the retaining loop 240A of FIG. 2B. The heel anchor 310 is similar to the retaining loop 240 of FIG. 2A and the retaining anchor 245 of FIG. 2B.

The sling 305 is connected through the retaining loop 330 as well as affixed to the anchor 320 and the anchor 325. In certain embodiments, the anchors 320 and 325 can be a single anchor such as illustrated in FIG. 2A. The anchors 320 and 325 can be affixed to the inside of a shoe (not shown). The anchors 320 and 325 include an adhesive member and placed at or near a location within a shoe where the ball of the user's foot is generally located (i.e., inside the shoe at the right and left sides of the ball of the foot). In certain embodiments, the anchors 320 and 325 are an adhesive member and placed at or near the location at the narrowest portion of the insole of a shoe (i.e., inside the shoe at the right and left sides of the narrowest point in the shoe). In certain embodiments, the anchors 320 and 325 are affixed on top of the insole (such as the insole 212 of FIGS. 2A and 2B) on the right and left side, inside of a shoe. In certain embodiments, the anchors 320 and 325 are affixed on both the top of the insole (such as the insole 212 of FIGS. 2A and 2B) and extend along the inner wall of the shoe. The anchors 320 and 325 can be affixed to the shoe using any known method in the art. For example, anchors 320 and 325 may be affixed by a hook, an adhesive, a snap, a button, or any other mechanical or chemical means known in the art.

Retaining loop 330 is affixed to the heel anchor 310. The heel anchor 310 is affixed to the inside wall of the heel quarter (such as the heel quarter 219 of FIGS. 2A and 2B) of a shoe. The heel anchor 310 is affixed to the shoe using any known method in the art. For example, the heel anchor 310 may be affixed by a hook, an adhesive, a snap, a button, or any other mechanical or chemical means known in the art.

FIG. 3B illustrates the heel anchor 310 with a cutout 315. The cutout 315 may be utilized to assist heel anchor 310 to fit flush against the heel of the shoe. For example, the cutout 315 enables the heel anchor 310 to adjust to the curve with the heel quarter of the shoe.

The retaining loop 330 may be any material as similarly described in reference to the strap member 220A and 220B above. For example, the retaining loop 330 and the strap member 220A and 220B can be the same material or different materials.

Those skilled in the art can appreciate that the heel anchor 310, the anchor 320, and the anchor 325 may take on any shape in order to affix to the shoe. For example, the heel anchor 310, the anchor 320, and the anchor 325 may have straight or curved edges, and may resemble any shape, including but not limited to: a circle, an oval, an ellipse, a star, a parallelogram, a square, a rectangle, a trapezoid, a triangle, a diamond, a rhombus, a pentagon, a hexagon, an octagon etc. Additionally, the heel anchor 310, the anchor 320, and the anchor 325 can be flat or curved. For example the heel anchor 310 can be curved to fit in the heel quarter (such as the heel quarter 219 of FIGS. 2A and 2B). In another example, the anchor 320, and the 325 can be curved to extend from the insole of the shoe up the inside of the shoe wall.

In certain embodiments, the sling 305 can pass freely through the retaining loop 330. On one or both sides of the retaining loop 330 the heel strap member 305A and 305B can include an adjuster 340A and 340B. In certain embodiments, only one adjuster (such as the adjuster 340A) are used as the heel strap members 305A and 305B may freely move through retaining loop 330. In certain embodiments, two adjusters (such as the adjuster 340A and the adjuster 340B) are used. Two adjusters can be used regardless if heel strap members 305A and 305B are able to freely move through the retaining loop 330 or rigidly affixed to heel anchor 310. The heel strap loops 307A and 307B illustrate slack in heel strap member which can be increased or decreased dependent on the placement of the adjusters 340A and 340B. The adjuster 340A is affixed to the end of the heel strap member 305A. The adjuster 340A allows the heel strap member 305A to pass through the openings to adjust the size and length of the heel strap member 305A. In certain embodiments, the heel strap loop 307A and the heel strap member 305A have a 2:1 relationship. For example, the heel strap member 305A is lengthened twice as much as the heel strap loop 307A is reduced. Alternative relationships can be used based on the shape and configuration of the adjuster. Similar adjustments may be implemented with respect to the heel strap member 305B, the heel strap loop 307B, and the adjuster 340B.

Figure 4A:
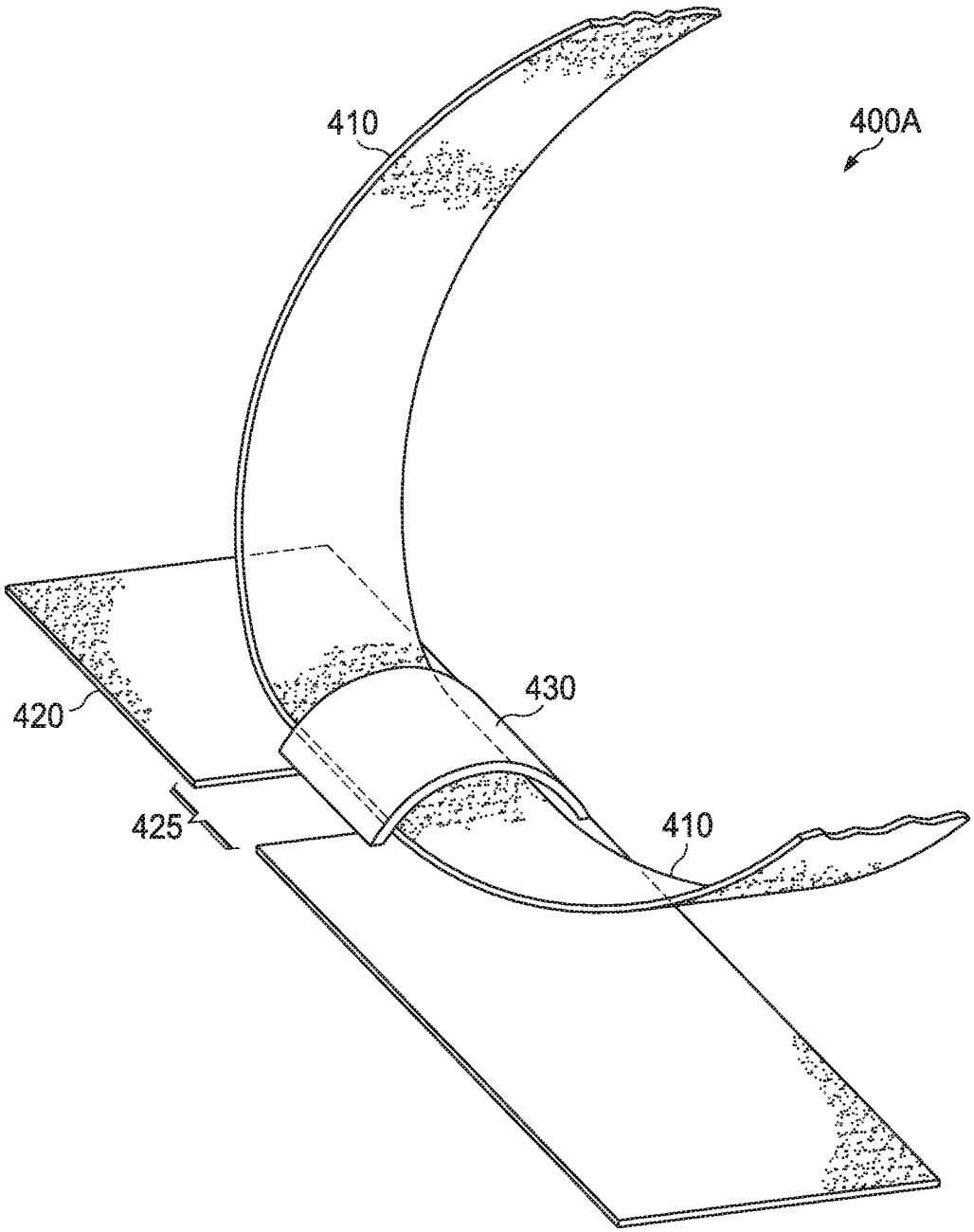
FIG. 4A illustrates a heel attachment portion of a shoe sling, according to an embodiment of this disclosure.

FIG. 4A illustrates environment 400A depicting a schematic view of a heel attachment portion of a shoe sling, according to an embodiment of this disclosure. The embodiment of the environment 400A of FIG. 4A is for illustration only. Other embodiments can be used without departing from the scope of the present disclosure.

The heel strap member 410 passes through the retaining loop 430. The retaining loop 430 is affixed to the heel anchor 420. In certain embodiments the heel anchor 420 includes a cutout, such as the cutout 425. The cutout 425 enables the heel anchor 420 to be affixed to the curved portion of the heel quarter inside a shoe. The retaining loop 430 is similar to the retaining loop 240 of FIG. 2A, the retaining loop 240A of FIG. 2B, and the retaining loop 330 of FIGS. 3A and 3B. The heel anchor 420 is similar to the retaining loop 240 of FIG. 2A, the retaining anchor 245 of FIG. 2B, and the heel anchor 310 of FIGS. 3A and 3B. The heel strap member 410 is similar to the heel strap member 130 of FIG. 1, the sling 220 of FIG. 2, and the sling 305 of FIGS. 3A and 3B.

Figure 4B:
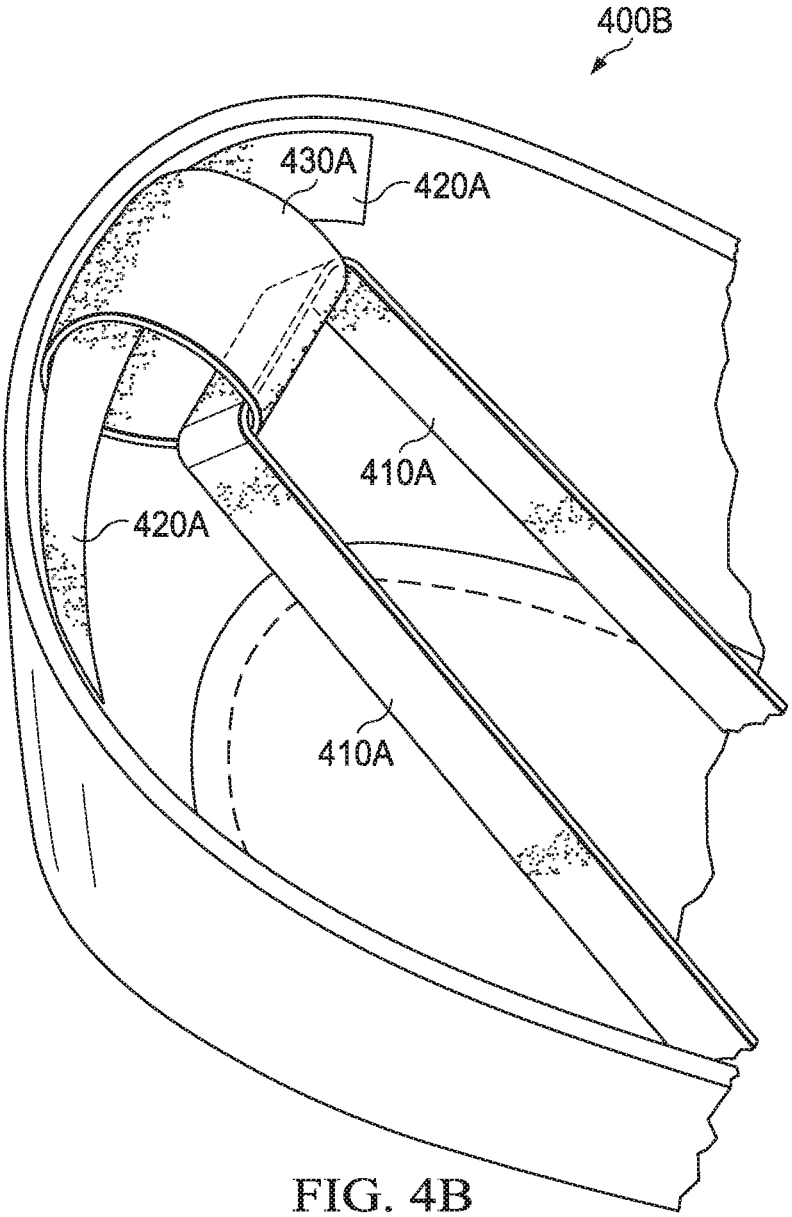
FIGS. 4B and 4C illustrate a heel attachment portion of a shoe sling affixed to the inside of a shoe, according to an embodiment of this disclosure.

FIG. 4B illustrates environment 400B depicting a heel attachment portion of a shoe sling affixed to the inside of a shoe, according to an embodiment of this disclosure. The embodiment of the environment 400B of FIG. 4B is for illustration only. Other embodiments can be used without departing from the scope of the present disclosure.

The retaining loop 430A is similar to the retaining loop 240 of FIG. 2A, the retaining loop 240A of FIG. 2B, the retaining loop 330 of FIGS. 3A and 3B, and the retaining loop 430 of FIG. 4A. The heel anchor 420*a* is similar to the retaining loop 240 of FIG. 2A, and the heel anchor 310 of FIGS. 3A and 3B. The heel strap member 410A is similar to the heel strap member 130 of FIG. 1, the sling 220 of FIG. 2, the sling 305 of FIGS. 3A and 3B, and the heel strap member 410 of FIG. 4A.

The retaining loop 430A can be a cylindrical shape such that the heel strap member 410A passes through freely. The retaining loop 430A is affixed to the shoe by the heel anchor 420*a*. In certain embodiments, the heel anchor 420A can pass through the retaining loop 430A, affixing the retaining loop 430A to the shoe. In certain embodiments the retaining loop 430A is affixed to the heel anchor 420A, and the heel anchor 420A is affixed to the shoe. The retaining loop 430A can expand and stretch to provide a secure fit around the foot of a user.

Figure 4C:
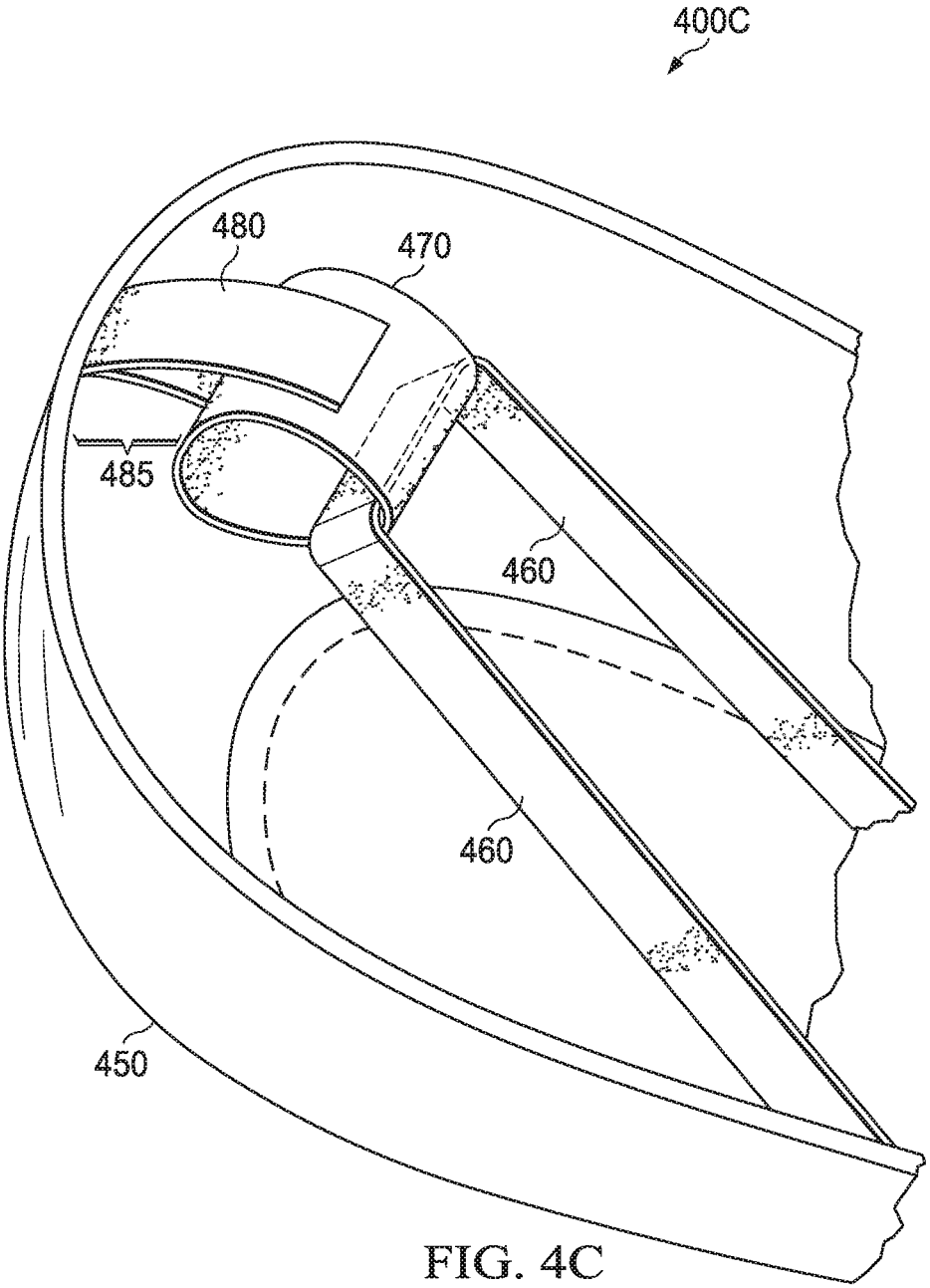

FIG. 4C illustrate environment 400C depicting a heel attachment portion of a shoe sling affixed to the inside of a shoe, according to an embodiment of this disclosure. The embodiment of the environment 400C of FIG. 4C is for illustration only. Other embodiments can be used without departing from the scope of the present disclosure.

The heel strap member 460 is similar to the heel strap member 130 of FIG. 1, the sling 220 of FIG. 2, the sling 305 of FIGS. 3A and 3B, the heel strap member 410 of FIG. 4A, and the heel strap member 410A of FIG. 4B. The retaining loop 470 is similar to the retaining loop 240 of FIG. 2A, the retaining loop 240A of FIG. 2B, the retaining loop 330 of FIGS. 3A and 3B, the retaining loop 430 of FIG. 4A, and the retaining loop 430A of FIG. 4B. The heel anchor 420 is similar to the retaining loop 240 of FIG. 2A, the retaining anchor 245 of FIG. 2B, and the heel anchor 310 of FIGS. 3A and 3B. The heel retainer extender 480 is an extender that is affixed to the heel anchor 420 of FIG. 4A.

The heel strap member 460 passes through the retaining loop 470. The retaining loop 470 is affixed to the heel retainer extender 480. In certain embodiments, the heel retainer extender 480 is affixed directly to shoe 450 or to a heel anchor (similar to the heel anchor 420 of FIG. 4A and the heel anchor 420A of FIG. 4B and). The heel strap member 460 is designed to mold around the heel of a user's foot. The heel strap member 460 may expand to fit the contours of the user's heel and foot. The retaining loop 470 is a loop which conforms to the back of the user's heel and is affixed on the top and bottom to the heel retainer extender 480. The heel retainer extender 480 provides a degree of separation from the retaining loop 470 and the inside of the shoe. The separation allows the user's foot to be held in place by the heel strap member 460 and not the shoe. The separation is denoted by a distance 485. The distance 485 may vary. By providing tension and pulling the foot forward via the heel strap member 460 and not the shoe, minimal to no rubbing of the foot against the shoe occurs. For example, each step the user walks, from the 'roll' and 'toe off' the user's heel may not be in contact with the heel quarter of the shoe, as the foot may only be in contact with the heel strap member 460.

Figure 5A:
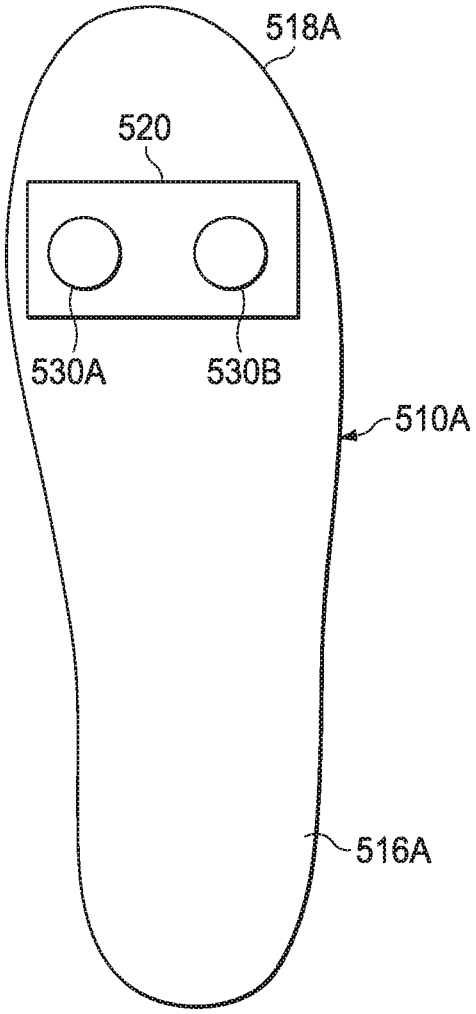
FIGS. 5A and 5B, illustrate a ball attachment portion of a shoe sling affixed to the inside of a shoe, according to an embodiment of this disclosure.
Figure 5B:
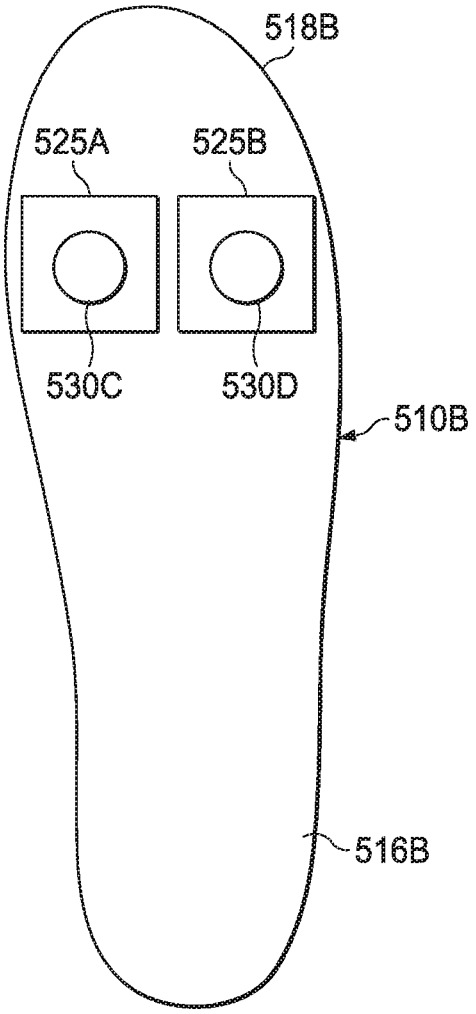

FIGS. 5A and 5B, illustrate a ball attachment portion of a shoe sling affixed to the inside of a shoe, according to an embodiment of this disclosure. The embodiments of the FIGS. 5A and 5B are for illustration only. Other embodiments can be used without departing from the scope of the present disclosure.

FIG. 5A depicts the insole 510A, the heel seat 516A, the toe region 518A, the sling anchor 520. The sling anchor 520 anchors the sling 530A and 530B to the insole 510A. FIG. 5B depicts the insole 510B, the heel seat 516B, the toe region 518B, the sling anchor 525A and the sling anchor 525B. The sling anchor 525A anchors sling 530C to the insole 510B and the sling anchor 525B anchors sling 530D to the insole 510B.

In certain embodiments, the insole 510A and insole 510B are the same. Similarly, the heel seat 516A and 516B are the same, as well as the toe region 518A and the toe region 518B. The sling anchor 520 is a single anchor that crosses the entirety of the insole 510A. The sling anchor 525A and 525B are separate anchors each affixed individually to the insole 510B.

The insoles 510A and 510B are similar to the insole 212 of FIG. 2A. The heel seat 516A and 516B are similar to the heel seat 216 of FIGS. 2A and 2B. The toe region 518A and 518B is similar to the toe region 218 of FIGS. 2A and 2B. The anchor 520, is similar to the anchor 230 of FIG. 2A. The anchor 525A and 525B are similar to the anchor 320 and the anchor 325 of FIGS. 3A and 3B. The sling 530A, 530B, 530C, and 530D are similar to the heel strap member 130 of FIG. 1, the sling 220 of FIG. 2, the sling 305 of FIGS. 3A and 3B, the heel strap member 410 of FIG. 4A, the heel strap member 410A of FIG. 4B, and heel strap member 460 of FIG. 4C.

The anchor 520 can be any shape designed to fit within a shoe. The anchor 520 affixes the sling 530A and 530B to the insole 510A of the shoe. In certain embodiments, the anchor 520 extends from its depicted location up an inner wall of the shoe and the sling 530A and 530B are affixed to the anchor 520 at wall of the shoe and not at the insole 510A.

The anchor 525A and 525B can be any shape designed to fit within a shoe. The anchor 525A affixes the sling 530C to the insole 510B of the shoe. Similarly, the anchor 525B affixes the sling 530D to the insole 510B of the shoe. In certain embodiments, the anchor 525A and 525B extends from it is depicted on the insole 510B up the inner wall of the shoe and the sling 530A and 530B are affixed to the anchor 525A and 525B respectively, at wall of the shoe and not at the insole 510A.

Figure 5C:
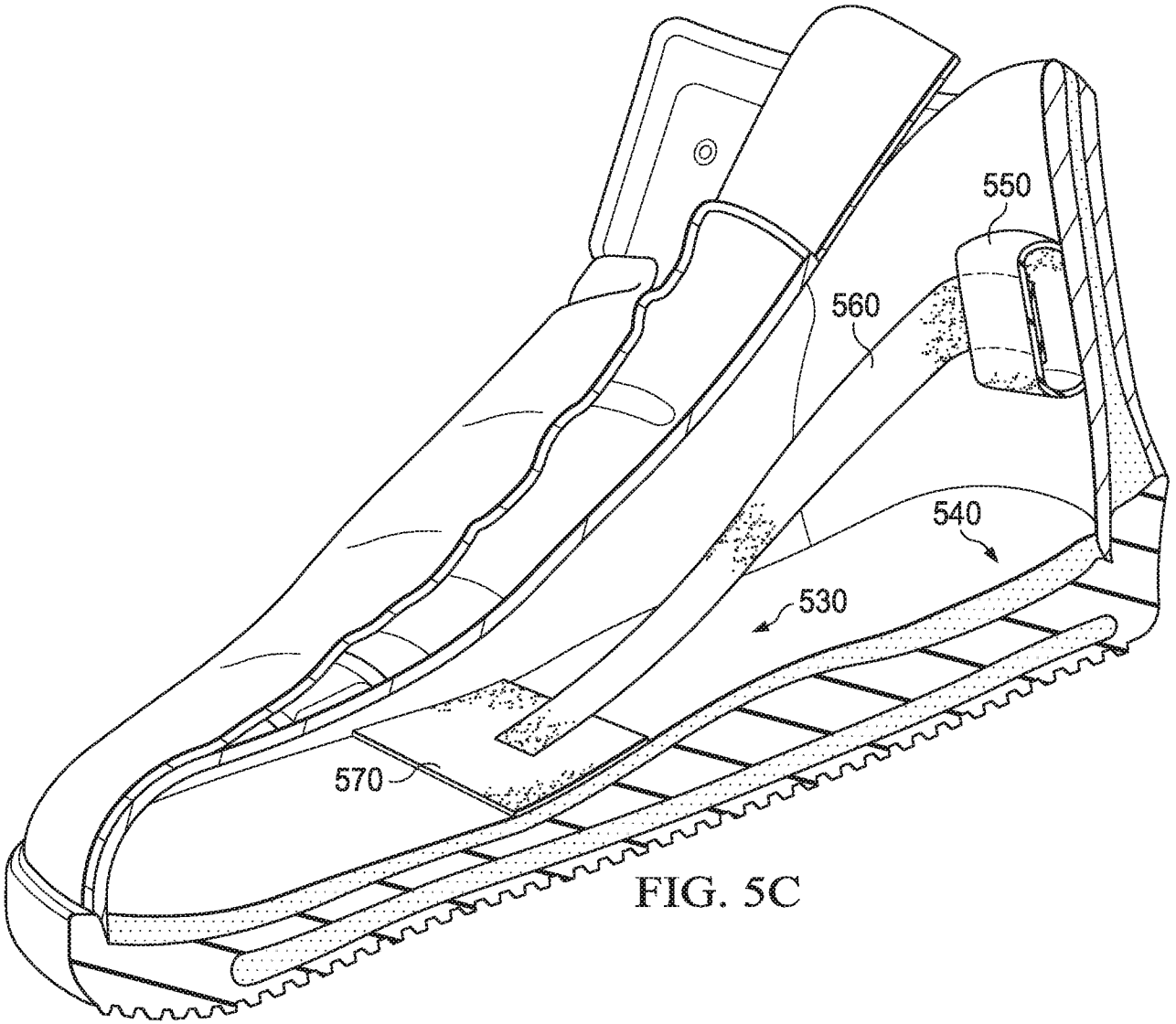
FIG. 5C illustrates a cross sectional view of a shoe with an affixed shoe sling, according to an embodiment of this disclosure.

FIG. 5C illustrates a cross sectional view of a shoe with an affixed shoe sling, according to an embodiment of this disclosure. The embodiment of the FIG. 5C is for illustration only. Other embodiments can be used without departing from the scope of the present disclosure.

The insole 530 is similar to the insole 212 of FIG. 2A, the insole 510A of FIG. 5A and the insole 510B of FIG. 5B. The heel seat 540 is similar to the heel seat 216 of FIGS. 2A and 2B, the heel seat 516A of FIG. 5A, and heel seat 516B of FIG. 5B. The retaining loop 550 is similar to the retaining loop 240 of FIG. 2A, the retaining loop 240A of FIG. 2B, the retaining loop 330 of FIGS. 3A and 3B, the retaining loop 430 of FIG. 4A, and the retaining loop 430A of FIG. 4B. The heel strap member 560 is similar to the heel strap member 130 of FIG. 1, the sling 220 of FIG. 2, the sling 305 of FIGS. 3A and 3B, the heel strap member 410 of FIG. 4A, and the heel strap member 410A of FIG. 4B, the heel strap member 460 of FIG. 4C, the sling 530A, and 530B of FIG. 5A, and the sling 530C, and 530D of FIG. 5B. The anchor 570, is similar to the anchor 230 of FIG. 2A, the anchors 320 and the anchor 325 of FIGS. 3A and 3B, the anchor 520 of FIG. 5A, and the anchors 525A and 525B of FIG. 5B.

The heel strap member 560 is affixed to both the anchor 570 and passes through the retaining loop 550. FIG. 5C only depicts half of the heel strap member 560 due to the cross sectional nature of the figure. A wearer inserts their foot into the shoe and the heel strap member 560 conforms around the foot and provides a secure fit.

In certain embodiments, the retaining loop 550 is located a predetermined height up the heel quarter of the shoe. For example, the retaining loop 550 is positioned half way up the heel quarter of the shoe from the insole 530. In another example, the retaining loop 550 is positioned one third of the way up the heel quarter of the shoe from the insole 530. In another example, the retaining loop 550 is positioned two third of the way up the heel quarter of the shoe from the insole 530.

In certain embodiments, the anchor 570 is located at the location in the shoe where the ball of the foot of the wearer rests. In certain embodiments, the anchor 570 is located at the narrowest portion of the insole 530. In certain embodiments, the anchor 570 is located on the inside wall of the shoe in proximity to the location of where the ball of the user's foot is located within the shoe, when the user is wearing the shoe.

Figure 6A:
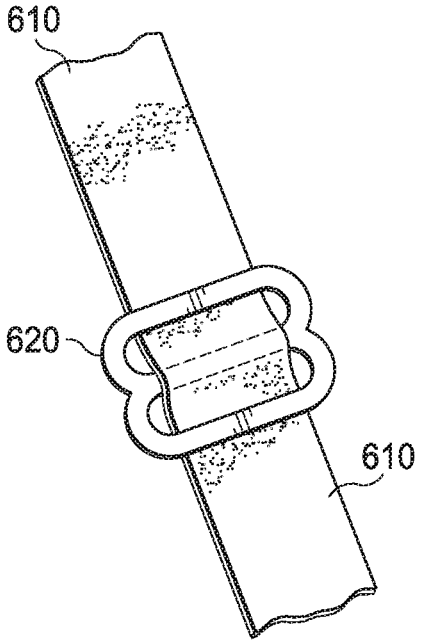
FIGS. 6A and 6B illustrate an adjuster apparatus of a shoe sling, according to an embodiment of this disclosure.
Figure 6B:
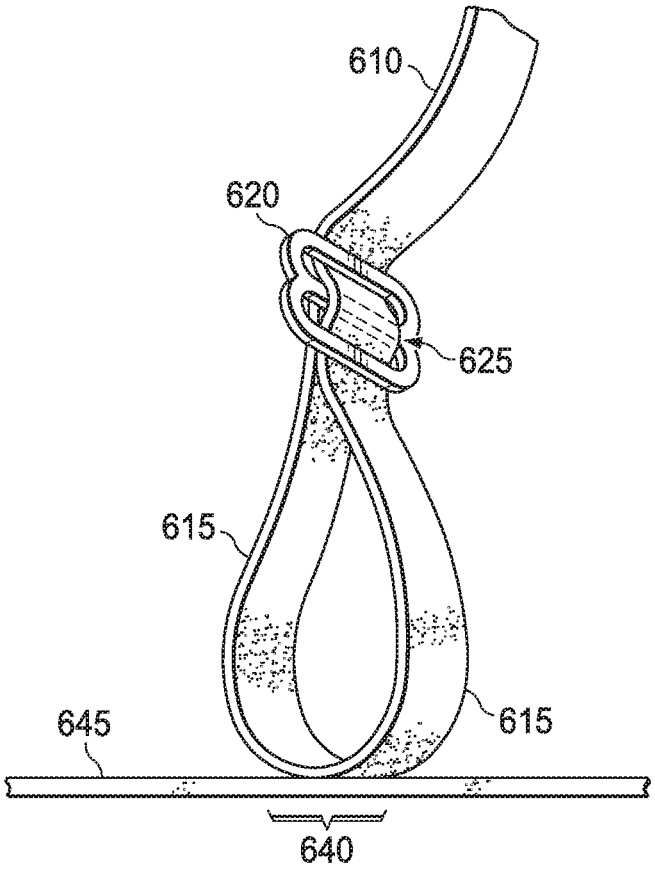

FIGS. 6A and 6B illustrate an adjuster apparatus of a shoe sling, according to an embodiment of this disclosure. The embodiments of the FIGS. 6A and 6B are for illustration only. Other embodiments can be used without departing from the scope of the present disclosure.

The adjuster 620 is similar to the adjuster 340A and 340B of FIGS. 3A and 3B. The heel strap member 610 is similar to the heel strap member 130 of FIG. 1, the sling 220 of FIG. 2, the sling 305 of FIGS. 3A and 3B, the heel strap member 410 of FIG. 4A, and the heel strap member 410A of FIG. 4B, the heel strap member 460 of FIG. 4C, the sling 530A, and 530B of FIG. 5A, the sling 530C, and 530D of FIG. 5B, and the heel strap member 560 of FIG. 5C.

FIG. 6A illustrates an adjustment mechanism as the heel strap member 610 passing through the adjuster 620. FIG. 6B illustrates the heel strap member 610 passing through the two openings on the adjuster 620 and converts to the heel strap member 610 to the heel strap loop 615. The heel strap loop 615 and the heel strap member 610 are a single element. The heel strap loop 615 is affixed to the anchor 645 at location 640. The heel strap loop 615 is also affixed to the adjuster 620 at the location 625. The location 625 is the cross piece of the adjuster 620. Therefore, by having the heel strap loop 615 affixed on one side of the adjuster 620 at the location 625 and able to slide through the adjuster 620 enables the heel strap member 610 to be change its overall length. The adjuster 620 secures the heel strap member 610 by providing tension to prevent the heel strap member 610 from freely changing length. Alternative embodiments may use other mechanisms to adjust the length of the heel strap member 610.

In one or more of the above examples, the heel strap is elastic. In one or more of the above examples, the heel strap is inelastic. In one or more of the above examples, the heel strap grips the user's heel and prevents the user's heel from slipping. In one or more of the above examples, the adjuster is a Velcro™ fastener. In one or more of the above examples, the adjuster is a buckle fastener. In one or more of the above examples, the adjuster is a snap fastener. In one or more of the above examples, the adjuster is a hook fastener. In one or more of the above examples, a shoe includes the heel strap anchored in the shoe. In one or more of the above examples, the heel strap is an aftermarket attachment to a shoe.

Although the figures illustrate different examples of user equipment, various changes may be made to the figures. For example, the user equipment can include any number of each component in any suitable arrangement. In general, the figures do not limit the scope of this disclosure to any particular configuration(s). Moreover, while figures illustrate operational environments in which various user equipment features disclosed in this patent document can be used, these features can be used in any other suitable system None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle. Use of any other term, including without limitation "mechanism," "module," "device," "unit," "component," "element," "member," "apparatus," "machine," "system," "processor," or "controller," within a claim is understood by the applicants to refer to structures known to those skilled in the relevant art and is not intended to invoke 35 U.S.C. § 112(f).

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An apparatus within a shoe, the apparatus comprising:
a first anchor and a second anchor affixed on a top surface of an insole within the shoe and in proximity to a toe region of the shoe;
a heel anchor affixed to an inside wall of a heel quarter of the shoe;
a retaining loop affixed to the heel anchor;
a heel strap that extends from the first anchor through the retaining loop and to the second anchor, wherein the heel strap is a single strap and includes a first loop affixed to the first anchor and a second loop affixed to the second anchor, and wherein the heel strap is slideably connected through the retaining loop; and
an adjuster affixed on the heel strap and configured to adjust a length of the heel strap.

2. The apparatus of claim 1, wherein:
the retaining loop is a first material, and
the heel strap is a second material and is configured to apply tension along a foot while the first anchor and the second anchor are affixed on the top surface of the insole and the heel anchor is affixed to the inside wall of the heel quarter of the shoe.

3. The apparatus of claim 1, wherein the heel strap is at least one of: an elastic material or a flexible material.

4. The apparatus of claim 1, wherein the heel strap is at least one of: clear or opaque.

5. The apparatus of claim 1, wherein the first anchor and the second anchor are affixed by an adhesive to the top surface of the insole of the shoe.

6. The apparatus of claim 5, wherein the first anchor and the second anchor are positioned within a proximity to a ball of a foot when the foot is inserted into the shoe.

7. The apparatus of claim 1, wherein:
the heel anchor comprises:
a first surface that is affixed to the retaining loop, and
a second surface that includes an adhesive, and
wherein the heel anchor is affixed by the adhesive to the inside wall of the heel quarter of the shoe.

8. The apparatus of claim 1, wherein:
the adjuster is a first adjuster that is affixed to a first end of the heel strap and is configured to form the first loop between the first anchor and the first adjuster;
to adjust the length of the heel strap, the first adjuster is configured to increase or decrease a size of the first loop; and
the apparatus further comprises a second adjuster that is affixed to a second end of the heel strap and configured to:
form the second loop between the second anchor and the second adjuster, and
increase or decrease a size of the second loop to adjust the length of the heel strap.

9. The apparatus of claim 1, wherein the adjuster is a buckle fastener.

10. The apparatus of claim 1, wherein:
the heel anchor is affixed to the inside wall of the heel quarter by an adhesive, and
the inside wall of the heel quarter is an internal sidewall surface of the shoe.

11. The apparatus of claim 1, wherein the first anchor and the second anchor are a single anchor that is affixed to the top surface of the insole of the shoe by an adhesive.

12. The apparatus of claim 1, wherein the first anchor and the second anchor are affixed to different locations on the top surface of the insole of the shoe.

13. A shoe comprising:

an insole;

a first anchor and a second anchor affixed on a top surface of the insole and in proximity to a toe region of the shoe;

a heel anchor affixed to an inside wall of a heel quarter of the shoe;

a retaining loop affixed to the heel anchor;

a heel strap that extends from the first anchor through the retaining loop and to the second anchor, wherein the heel strap is a single strap and includes a first loop affixed to the first anchor and second loop affixed to the second anchor, and wherein the heel strap is slideably connected through the retaining loop; and an adjuster affixed on the heel strap configured to adjust a length of the heel strap.

14. The shoe of claim 13, wherein:

the retaining loop is a first material, and the heel strap is a second material and is configured to apply tension along a foot while the first anchor and the second anchor are affixed on the top surface of the insole and the heel anchor is affixed to the inside wall of the heel quarter of the shoe.

15. The shoe of claim 13, wherein the heel strap is at least one of: an elastic material or a flexible material.

16. The shoe of claim 13, wherein the first anchor and the second anchor are affixed by an adhesive to the top surface of the insole of the shoe.

17. The shoe of claim 13, wherein the heel anchor is affixed by an adhesive to the inside wall of the heel quarter of the shoe.

18. The shoe of claim 13, wherein the first anchor and the second anchor are a single anchor that is affixed to the top surface of the insole by an adhesive.

* * * * *